United States Patent [19]

Stupakis

[11] Patent Number: 4,763,597

[45] Date of Patent: Aug. 16, 1988

[54] FOLDING ANCHOR

[75] Inventor: John S. Stupakis, Arcadia, Calif.

[73] Assignee: JSS Scientific Corporation, Arcadia, Calif.

[21] Appl. No.: 40,023

[22] Filed: Apr. 20, 1987

[51] Int. Cl.[4] ..... B63B 21/44

[52] U.S. Cl. ..... 114/297; 114/303

[58] Field of Search ..... 114/294, 295, 296, 297, 114/298, 299, 300, 301, 302, 303, 304, 305, 306, 307, 308, 309, 310, 311

[56] References Cited

U.S. PATENT DOCUMENTS

| | | | |
|---|---|---|---|
| 103,205 | 5/1870 | Law . | |
| 2,720,184 | 10/1955 | Polenz | 114/208 |
| 2,905,128 | 9/1959 | Northrop | 114/302 |
| 3,215,111 | 11/1965 | McDaniel | 114/208 |
| 3,263,642 | 8/1966 | Wilson | 114/208 |
| 3,716,012 | 2/1973 | Wright | 114/304 |
| 3,793,977 | 2/1974 | Ziegler | 114/305 |
| 3,807,340 | 4/1974 | Diorio | 114/208 |
| 3,822,666 | 7/1974 | Blomberg | 114/303 |
| 3,964,420 | 6/1976 | Stelling | 114/303 |
| 4,369,727 | 1/1983 | Fasco | 114/310 |
| 4,385,584 | 5/1983 | Simpson | 114/301 |
| 4,596,202 | 6/1986 | Brewster | 114/303 |

*Primary Examiner*—Joseph F. Peters, Jr.
*Assistant Examiner*—Stephen P. Avila
*Attorney, Agent, or Firm*—Gausewitz, Carr & Rothenberg

[57] ABSTRACT

A folding anchor having a shank formed in two pieces and joined together with a keyhole fitting, and, upon pivoting the upper shank abuttingly overlies the lower shank. The fluke assemblies are pivotally connected via a coupling assembly at the lower end of the shank, the coupling assembly including a retaining member for pivotal coupling to the fluke assemblies and a slide block member having a passage for receiving the retaining member therein, displacement of one relative to the other enabling pivoting of the fluke assemblies between folded and unfolded positions, this being accomplished by 90 degree pivoting of the fluke assemblies about first axes generally parallel to the lonitudinal axis of the shank, whereby the two flukes may be rotated toward each other into proximate facing relation, or away from each other into alignment. The interconnection of the shank with the retaining member, along with the dimensioning and configuration of the slide block member, enables a limited amount of angular movement on a second axis orthogonal to the longitudinal axis of the shank relative to the flukes to facilitate engagement and disengagement relative to the sea bed. The flukes are generally right triangularly configured and formed of plate metal, the shank portions are formed of metal bar stock, and the balance of the anchor is formed from readily available metal stock assembled with conventional metal fabrication methods, such as welding and bending.

23 Claims, 2 Drawing Sheets

FOLDING ANCHOR

BACKGROUND OF THE INVENTION

The background of the invention will be discussed in two parts.

1. Field of the Invention

This invention relates to anchors, and more particularly to a folding anchor for small watercraft.

2. Description of the Prior Art

Anchors generally include a shank with a fluke arrangement at one end of the shank, the other end of the shank being connected to an anchor chain. Generally, the flutes are attached to the shank to permit a limited amount of angular movement. When the anchor is lowered into the sea, the flukes engage the sea bottom, with the shank extending at an angle to the sea bottom in a forward direction, that is, in the direction of the boat. For release of the anchor from engagement with the sea bottom, the boat direction is reversed to provide a direction of force thereon opposite to the direction of engagement of the flukes. To facilitate release, some anchors have been formed with two-piece shanks coupled for limited pivotal movement at a point intermediate the ends of the overall shank.

One such anchor is disclosed in U.S. Pat. No. 103,205, entitled "Anchor", such patent issuing on May 17, 1870 to Law. The anchor of this patent includes a two piece shank, with the upper shank piece being pivotable through a limited angle relative to the lower shank, to which is attached a fluke assembly, which is likewise pivotable through a limited angle.

Another anchor construction is shown and described in U.S. Pat. No. 2,720,184, entitled "Articulated and Self-Locking Shank for Anchor", issued to Polenz on Oct. 11, 1955, such patent disclosing an anchor with a two-piece shank, the interconnection of the two pieces being by means of a keyhole slot engaged by a block member. In one position, the block is locked within the narrow neck of the slot with the two shank pieces in axial alignment. When force is exerted by the anchor chain in an opposite direction, tho upper shank moves rearwardly relative to the lower shank until the block is in the enlarged portion of the keyhole, thereby permitting pivoting to facilitate release of the anchor from the sea bottom.

Another example of an articulated anchor structure is disclosed in U.S. Pat. No. 3,263,642, entitled "Boat Anchor", which issued to Wilson on Aug. 2, 1966, the anchor including a unitary fluke formed of plate metal with first and second symmetrically arranged slots with a common origin. The shank is formed as a yoke with a bar engaging the slot at the origin, with the bolt able to traverse either slot to facilitate removal of the flukes fro engagement with the sea bed.

Some anchors have been constructed to permit folding of the flutes and stock arms against the shank, such as shown in U.S. Pat. Nos. 3,215,111 and 3,807,340, the former being issued to McDaniel on Nov. 2, 1965, and the latter being issued to Diorio et al on Apr. 30, 1974. In both patents, the anchors are of the conventional Navy type and have the stock arms pivotally attached to the shank adjacent a first end thereof, with the flukes pivotally attached to the shank adjacent the other end thereof, with the plane of pivoting of the stock arms perpendicular to the plane of pivoting of the flukes. The Diorio anchor includes a spring member encircling the rod-shaped shank to spring load the stock arms to the ope position.

An anchor including flukes which may be physically detached from the shank for storage is shown and described in U.S. Pat. No. 3,822,666, entitled "Anchor", which issued to Blomberg on July 9, 1974.

The last three patents enumerated above concern themselves with anchors of the folding type, with the Blomberg and McDaniel anchors being more suited for small pleasure craft usage. The flukes formed of plate metal, as shown in Blomberg, are of widespread use in small craft anchors of recent vintage. Although the Blomberg anchor permits detachment of the flukes for storage and transportation by removal and reattachment of bolts, the anchor should be reassembled prior to casting off, thereby eliminating any storage space advantage while at sea. On the other hand, while the McDaniel anchor permits folding to a relatively small overall configuration, the length of the folded anchor is the same as the length of the shank. Furthermore, such Navy anchors do not have widespread acceptance among small pleasure craft users.

In accordance with an aspect of the invention, it is accordingly an object of the invention to provide a new and improved foldable small craft anchor.

SUMMARY OF THE INVENTION

The foregoing and other objects of the invention are accomplished by providing a folding anchor, having a shank formed in two pieces and joined together with a keyhole fitting, and, upon pivoting the upper shank abuttingly overlies the lower shank. The fluke assemblies are pivotally connected via a coupling assembly at the lower end of the shank, the coupling assembly including a retaining member for pivotal coupling to the fluke assemblies and a slide block member having a passage for receiving the retaining member therein, displacement of one relative to the other enabling pivoting of the fluke assemblies between folded and unfolded positions, this being accomplished by 90 degree pivoting of the fluke assemblies about first axes generally parallel to the longitudinal axis of the shank, whereby the two flukes may be rotated toward each other into proximate facing relation, or away from each other into alignment. The interconnection of the shank with the retaining member, along with the dimensioning and configuration of the slide block member, enables a limited amount of angular movement on a second axis orthogonal to the longitudinal axis of the shank relative to the flukes to facilitate engagement and disengagement relative to the sea bed. The flukes are generally right triangularly configured and formed of plate metal, the shank portions are formed of metal bar stock, and the balance of the anchor is formed from readily available metal stock assembled with conventional metal fabrication methods, such as welding and bending.

Other objects, features and advantages of the invention will become readily apparent from a reading of the specification, when taken in conjunction with the drawings, in which like reference numerals refer to like elements in the several views.

DESCRIPTION OF THE PREFERRED EMBODIMENT

Figure 1:
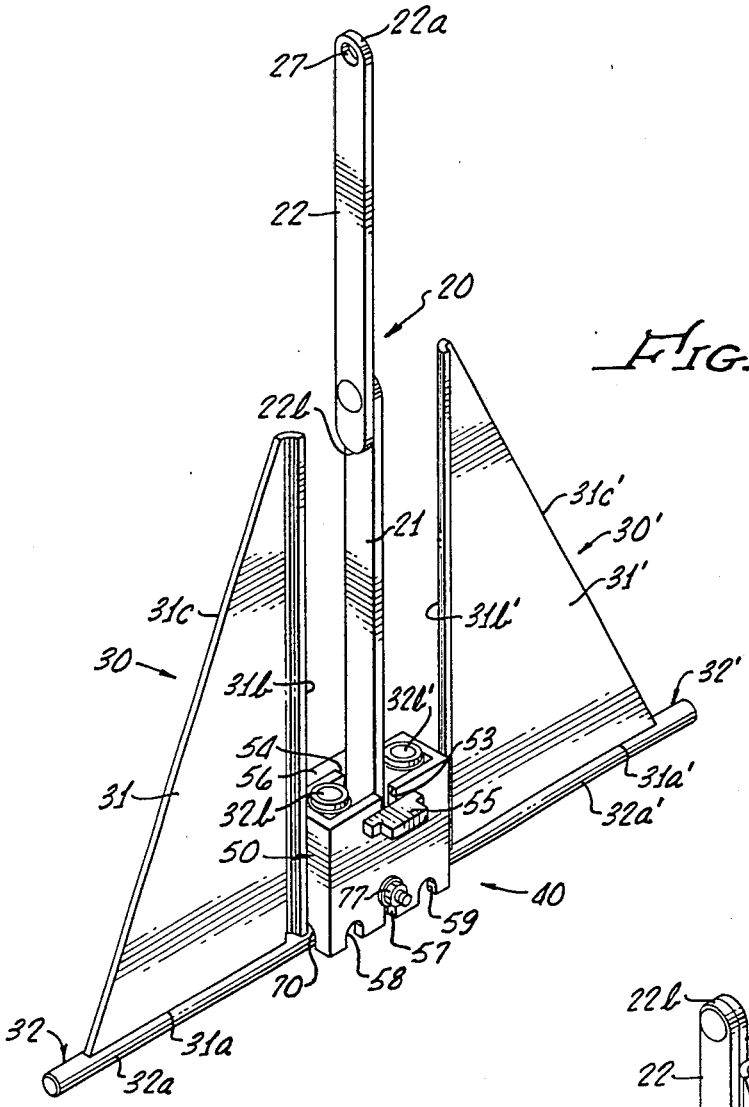
FIG. 1 is a perspective view of a foldable anchor according to the invention in its ready-for-use position.
Figure 2:
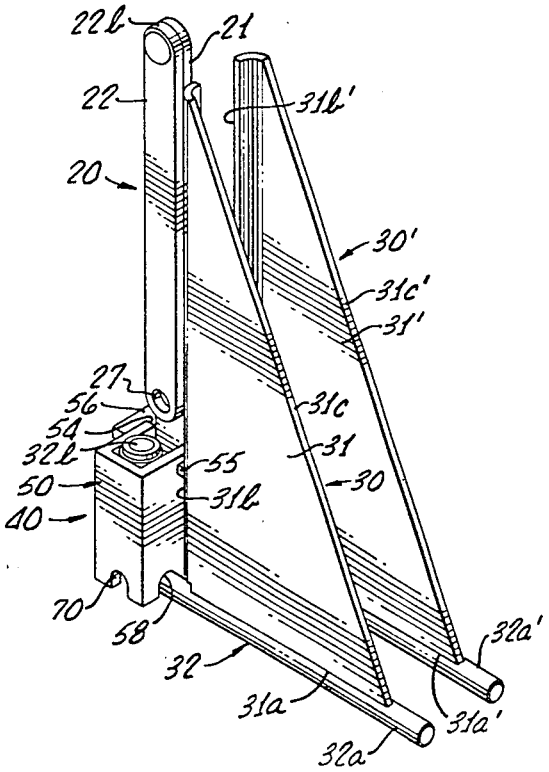
FIG. 2 is a perspective view of the foldable anchor of FIG. 1, shown in its folded position.

Referring now to the drawings, and particularly to FIGS. 1 and 2, there is shown a preferred embodiment of an anchor, generally designated 10, in accordance with the invention, the anchor 10 including a shank assembly, generally designated 20, two fluke assemblies, generally designated 30 and 30', and a coupling assembly, generally designated 40.

The shank assembly 20 is formed of first and second shank portions 21 and 22, each of which is formed of generally elongate metallic bar stock, and preferably double zinc coated for corrosion resistance. The shank portion 21 is the main, or lower shank portion, which is provided at one end 21*a* thereof with a keyhole slot 23 (shown in dotted lines in FIG. 5), having a circular portion 23*a* on the longitudinal centerline thereof, and a narrow necked portion 23*b* aligned with the centerline. The other end 21*b* of the shank portion 21 is provided with a generally circular opening 24, which is formed, such as by drilling in the metal bar stock. As shown, there is a generally L-shaped cut line, designated 25, of which one leg is tangential to the circumference of the opening 24 in a direction generally parallel to a long side of the shank portion 21. The other leg is cut perpendicular to that long side to intersect the first leg, as a consequence of which thus severed strip of metal, designated 26, may be bent outwardly relative to the aperture 24 (as shown in dotted lines in FIG. 6) for providing access for a pivot axis member into the opening 24, after which the strip 26 is then bent back to the position depicted in FIG. 5, encircling a portion of a retaining member 41, as will be hereafter described.

The other, or upper shank portion 22 is smaller in length than the upper shank portion 21, and is provided with a first enlarged aperture 27 at the one end 22*a* thereof, which aperture 27 is configured for connection to an anchor chain (not shown). A second smaller aperture (not shown) is provided adjacent the other end 22*b* of the shank portion 22 at a position displaced from the extreme end thereof. Both apertures 27 and 28 have the centers thereof on the longitudinal centerline of the shank portion 22. Pivotable interconnection of the upper and lower shank portions 21 and 22 is accomplished by means of a button head rivet member 29 passed through and affixed within the aperture of upper shank portion 22 and through the keyhole slot 23 of the lower shank portion 21.

Figure 5:
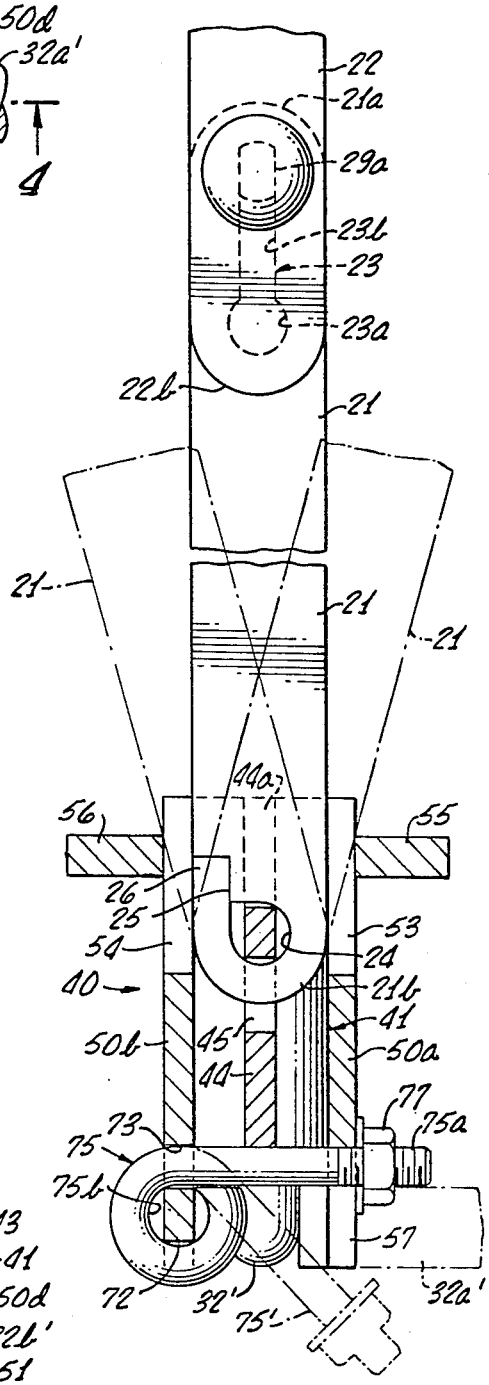
FIG. 5 is an enlarged partial cross-sectional view of the anchor of FIG. 1, as viewed along line 5—5 of FIG. 4.

The rivet member 29 has a keying shaft portion 29*a* with a generally rectangular configuration (See FIG. 5), the width of which is generally equal to the width of the necked portion 23*b* of the keyhole slot 23, and the length of which is slightly smaller than the diameter of the circular portion 23*a* of the keyhole slot 23. The shank portions 21 and 22 are thus locked together with the rectangular rivet shaft 29*a* within the necked portion 23*b* of the keyhole slot 23, and are pivotable relative to one another with the shaft 29*a* within the circular portion 23*a* of the keyhole slot 23. As shown in FIGS. 1 and 5, the distance between the lower aperture of the upper shank portion 22 relative to the end 22*b* thereof enables a significant amount of overlapping surface area at the junction of the two shank portions in the extended or unfolded position shown in FIG. 1, to provide good frictional engagement and structural support.

Referring to FIGS. 1 and 2, the fluke assemblies 30 and 30' are generally identically dimensioned and are configured in mirror image relation, that is, a left and right assembly. However, the parts from which the two assemblies are fabricated are identical, and include flukes 31 and 31', which are formed of plate metal, preferably zinc-coated, with right triangular configuration including short side 31*a* (31*a*'), long side 31*b* (31*b*') and hypotenuse side 31*c* (31*c*'). The short sides 31*a*, 31*a*' are suitably attached to fluke support members 32, 32', such as by welding. To provide rigidity, the edges of the long sides 31*b*, 31*b*' of the flukes 31, 31' are bent at right angles to the plane of the flukes 31, 31'. The support members 32, 32' are formed of tubular metal bent into an L-shaped configuration, with a long leg 32*a*, 32*a*' and a short leg 32*b*, 32*b*' (See also FIGS. 3 and 4), the side 31*a*, 31*a*' of the fluke 31, 31' being secured to the long leg 32*a*, 32*a*', with the plane of the fluke 31, 31' lying in a plane which includes the axial centerline of the long leg 32*a*, 32*a*', as well as the axial centerline of the short leg 32*b*, 32*b*'.

Referring also to FIGS. 3 through 6, the coupling assembly 40 interconnects the shank assembly 20 and the fluke assemblies 30 and 30', and for this purpose is provided with a fluke shaft retaining member 41 configured for being received with a slide block member 50. The fluke shaft retaining member 41 is formed from a generally rectangular metal plate having opposite sides bent to form first and second generally tubular cylinders 42 and 43, interconnected by a central web portion 44. The inner diameter of cylinders 42 and 43 are identical, and are slightly greater than the outer diameter of the short legs 32*b*, 32*b*' of the fluke support members 32, 32'. An upper edge of the web portion 44 is notched to form a generally centrally disposed slot 44*a* in axial alignment with an aperture 45 therebelow in the web portion 44.

Figure 6:
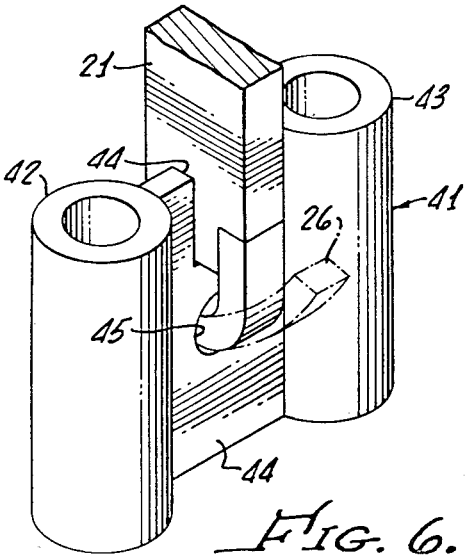
FIG. 6 is a partial perspective view depicting the lower end of the shank of the anchor of FIG. 1 connected to a retainer member.

As shown in FIG. 6, the metal strip 26 of the lower shank portion 21 is bent outwardly and inserted through the aperture 45 of web 44 of fluke retaining member 41, after which it is bent back to its original position, whereby the small portion of the web 44 intermediate the slot 44*a* and the aperture 45 are received within the aperture 24 of shank portion 21, as shown in FIG. 5. Thus the lower shank portion 21 is pivotably attached to the fluke retaining member 41.

Figure 3:
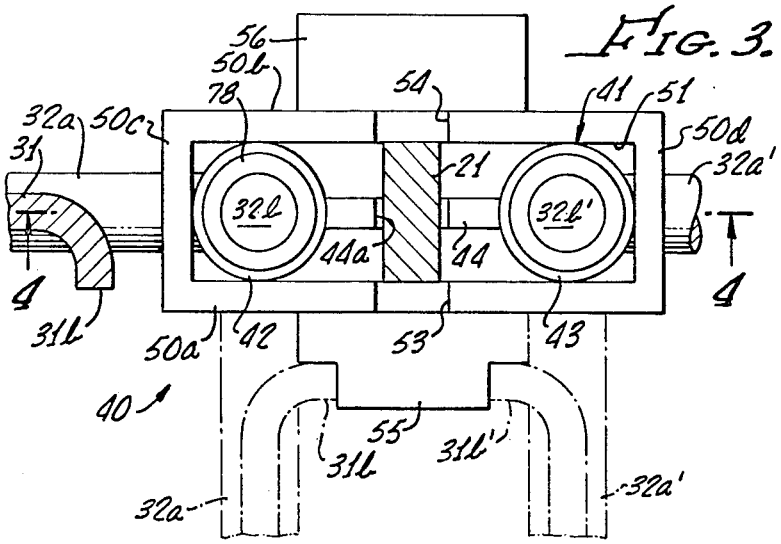
FIG. 3 is a enlarged partial top view of the anchor of FIG. 1 depicting, in dotted lines, the position of the fluke assemblies in the folded position.
Figure 4:
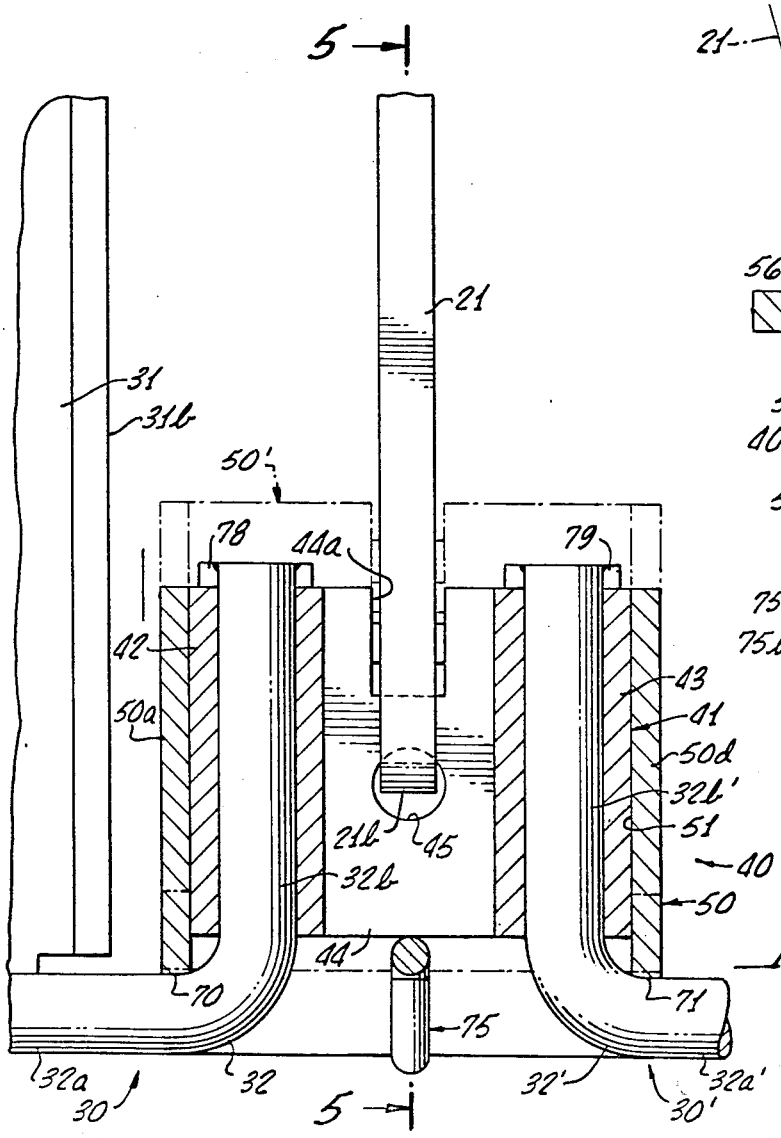
FIG. 4 is an enlarged partial cross-sectional view of the anchor of FIG. 1, as viewed along line 4—4 of FIG. 3.

The slide block member 50 is a rectangularly configured box-shaped member which is double open-ended to form a rectangular opening or passage 51 therethrough, the passage 51 being defined by opposing front and back walls 50*a* and 50*b* and interconnecting side walls 50*c* and 50*d* (See FIG. 3). The dimension between opposing facing surfaces of the front and back walls 50*a* and 50*b* is slightly greater then outer diameter of the cylinders 42, 43, while the dimension between the opposing facing surfaces of the side walls 50*c* and 50*d* is slightly greater than the dimension between opposite outer edges of the cylinders 42, 43. Thus, the passage 51 is dimensioned for slidably receiving therein, in snug fitting relationship, the fluke retaining member 41.

The upper edges of the opposing front and back walls 50*a* and 50*b* are provided with generally identical centrally disposed rectangular cutouts 53, 54, in aligned relation, the width of the cutouts 53, 54 being slightly greater than the thickness of the lower shank portion 21 of the shank assembly 20. On the external surfaces of the front and back walls 50*a* and 50*b*, first and second shank pivot limiting blocks 55, 56 are secured, such as by welding, across the opening of the cutouts 53, 54, respectively, at a distance below the upper edges of the walls 50*a*, 50*b*, and slightly above the lower edge of the cutouts 53, 54 (See, particularly, FIGS. 4 and 5). As will be described, with the shank assembly 20 and the fluke assemblies 30, 30' attached by means of the coupling assembly 40, the shank portion 21 pivoting is thus restricted to an angle of +/−15 degrees (as shown in dotted-lines in FIG. 5) relative to the plane of the web portion 44 of the fluke retaining member 41.

The lower edge of the front wall 50*a* is provided with three cutouts (See FIGS. 1 and 5), a centrally disposed elongate slotted cutout 57, with two somewhat larger, semicircularly configured cutouts 58, 59 symmetrically arranged on opposite sides of the central cutout 57. The diameter or width of the cutouts 58 and 59 is generally equal to the outer diameter of the fluke support members 30, 30'. The lower edges of side walls 50*c* and 50*d* likewise have aligned cutouts 70, 71 (See FIGS. 1 and 4), which are configured identically to the cutouts 58, 59. The distance between the centers of the cutouts 70, 71 is generally the same as the distance between the axial centerlines of the cylinders 42, 43, and the side cutouts 70, 71 have the centers thereof positioned centrally relative to the depth of the side walls 50*c*, 50*d*. The lower portion of the rear wall 50*b* is provided with a cutout 72 in alignment with the front slotted cutout 57, with an aperture 73 immediately thereabove. A fastening member 75 is provided, the fastening member 75 being formed from a threaded rod having a diameter slightly smaller than the diameter of the aperture 73, as well as the width of the cutout 57. One end of the rod is threaded, such as at 75*a*, and the other end is passed through the aperture 73, and then bent into a loop 75*b* (See FIG. 5), the opening of which has passing therethrough the necked portion of the rear wall 50*b* intermediate the aperture 73 and the adjacent cutout 72. The fastening member 75 is thus captively and pivotally attached to the centermost part of the lower edge of the rear wall 50*b*. In this position, the threaded end 75*a* passes into the elongate cutout 57, whereupon a suitable nut member 77 may be threaded thereon. To facilitate tightening and loosening, the nut member 77 may be provided as a winged nut member.

The anchor 10 is assembled in the following manner. The upper and lower shank portions 21 and 22 are connected by means of the rivet member 29 as previously described. The fluke members 31, 31' are suitably attached to the fluke support members 32, 32' as described. The lower end of the lower shank portion 21 is pivotably secured to the shank retaining member 42 as described (See FIG. 6). The fastening member 75 is pivotally attached to the rear wall 50*b* of the slide block 50 (See FIG. 5). The shank retaining member 41 is then inserted into the passage 51 of the slide block 50. The width of the shank portion 21 is slightly less than the width of the passage 51, and the length of the web portion 45 of the shank retaining member 41, in the insert direction is less than the length of the passage 51 in the direction of insertion (See FIGS. 3 and 4). The plane of the web portion 45 lies midway between the front and rear walls 50*a*, 50*b*, with the spacing between the web 45 and an adjacent interior wall being slightly more than the diameter of the rod from which the fastening member 75 is formed (See FIGS. 3 and 5).

The short leg 32*b* of fluke 30 is then inserted from the bottom into the cylinder 42 until the free end thereof protrudes slightly above the cylinder 42. A washer member 78 is then suitably affixed (See FIGS. 3 and 4), such as by welding, to the upper free end of the leg 32*b*, thereby enabling pivoting of the fluke assembly 30 about an axis through the axial centerline of cylinder 42, while preventing relative displacement in the direction of the axial centerline of the cylinder 42. The washer member 78 has an outer diameter approximately the same as the outer diameter of the cylinder 42, thereby captively retaining the leg 32*b* therein. The right fluke assembly 30' is then attached in the same manner with the washer member 79 secured to the free end of short leg 32*b'* after insertion into the right cylinder 43.

In the ready-for-use position shown in FIG. 1 (See also FIGS. 3 and 4), the shank portions 21 and 22 are extended and the fluke assemblies 30 and 30' are pivoted or extended until the long legs 32*a* and 32*a'* of fluke support members 32, 32' are in axial alignment. The retaining member 41 is in the solid line position shown in FIG. 4, with the legs 32*a*, 32*a'* coactingly recessed within the cutouts 70, 71, respectively, of the sidewalls 50*c*, 50*d*. The fastener member 75 has the shaft thereof in abutting engagement with the lower edge of web portion 44 of retaining member 41, with the threaded end 75*a* within slotted cutout 57, and the nut 76 tightened to secure the parts in position, as also shown in solid lines in FIG. 5.

For storage, as shown in FIG. 2, the shank portions 21 and 22 are pivoted into overlying relation, with the upper shank portion 22 being slightly smaller in length to clear the slide block 50 of the coupling assembly 40. To move the parts into this position, the nut 76 is loosened, allowing the fastener member 75 to pivot downwardly to the dotted line position shown in FIG. 5. The slide block 50 is displaced upwardly to the dotted line position shown in FIG. 4 relative to the shank retaining member 41 until the upper edges of the legs 32*a* and 32*a'* clear the lower edges of the sidewalls 50*c* and 50*d*, whereupon, the fluke assemblies 30, 30' may be rotated forwards toward each other until the legs 32*a*, 32*a'* are in alignment with the cutouts 58, 59, respectively, in the front wall 50*a* (See also FIG. 3). in this position, the fluke assemblies 30, 30' are in facing relation and, as shown in FIG. 3, the pivot stop block 55 is notched at the corners thereof to receive therein the angled edges 31*b*, 31*b'* of the flukes 31, 31', respectively.

The slide block member 50 is then displaced relative to the retaining member 41 until member 41 is retracted into passage 51 of slide block 50. The fastener member 75 is then pivoted from the dotted line position to the solid line position shown in FIG. 5 into the slotted cutout 57, and the nut 76 is tightened. The threaded end 75*a* of the fastener member 75 is sufficient in length that the member 75 may be rotated into and out of engagement with the slotted cutout 57, without totally removing the nut 76, thus enabling the fastener 75 and nut 76 to be held captively on the slide block member 50.

With the fluke assemblies 30, 30' rotated into aligned generally parallel relationship as shown in FIG. 2, that is, with the support members 32, 32' detentedly received within the cutouts 58, 59, respectively, and with the upper shank portion 22 rotated into overlying abutting relation with the lower shank portion 21, there is provided a folded anchor 10, with an overall folded dimension, on the broader side, approximately equal to the length and width of the fluke assembly 30 or 30', and on the narrow side, generally within the face dimension of the front or rear wa11 50*a* or 50*b* of the slide block member 50 (See FIG. 3). By way of example, and not of limitation, for an anchor 10 of approximately 17 pounds, these dimensions would be approximately eight inches by thirteen inches by four inches deep.

In the open position, the fluke assemblies 30, 30' are in fixed relation to slide block assembly 40, with the shank pivot block members 54, 55 limiting the pivoting of the shank assembly 20 through an angle of +/−15 degrees relative to a plane through the plane of the web portion 45 of the shank retaining member 41.

In accordance with the present invention, there has been shown and described an anchor 10, of economical fabrication of plate steel, bar steel and tubular steel, to provide an effective anchoring means with the anchor 10 being capable of folding into a compact arrangement. Furthermore, the sole threaded fastener 75 employed in the structure, is captively retained and dimensioned to preclude complete removal of the nut 76, thereby minimizing loss of necessary parts in operation between the folded and unfolded positions. While there has been shown and described a preferred embodiment, it is to be understood that various other adaptations and modifications may be made within the spirit and scope of the invention.

What is claimed is:

1. An anchor comprising:

shank means;

first and second fluke assemblies;

retainer means pivotally coupled to said shank means for relative pivoting about a first axis, said retainer means being coupled to each of said fluke assemblies for relative pivoting of said luke assemblies about generally parallel second and third axes extending in directions generally perpendicular to said first axis; and means in engagement with said retaining means for enabling pivoting and securing of said first and second fluke assemblies into one of a first folded position with said fluke assemblies in proximate facing relation and a second unfolded position with said fluke assemblies in general alignment, said means in engagement with said retaining means including wall means for defining passage means for slidably receiving said retaining means therein.

2. The anchor according to claim 1 wherien said means in engagement with said retaining means includes detent means in said wall means for coaction with said fluke assemblies for assisting in securing said fluke assemblies in the selected pivoted position.

3. The anchor according to claim 2 wherein said means in engagement with said retaining means includes fastener means coacting with said wall means means for preventing movement of said retaining means within said passage means.

4. The anchor according to claim 3 wherein said wall means are part of a generally rectangular box-like member and said passage means is an opening extending therethrough.

5. The anchor according to claim 4 wherein said shank means is pivotally attached at one end thereof to said retainer means, and said box-like member is configured for coactingly receiving said one end of said shank means, and wherein said member further includes means for permitting limited angular pivoting of said shank means relative to said retainer means.

6. The anchor according to claim 1 wherein said shank means includes a shank assembly having first and second generally elongate, generally bar-shaped, pivotally interconnected and lockable shank portions.

7. The anchor according to claim 6 wherein said first and second shank portions are interconnected by means of keyhole slot means.

8. The anchor according to claim 6 wherein each of said fluke assemblies includes a generally plate-shaped fluke member and a pivot shaft portion, said retaining means includes a pair of generally parallel cylindrical portions and said pivot shaft portions are pivotally connected within said cylindrical portions.

9. The anchor according to claim 8 wherein said retaining means includes a web portion intermediate said cylindrical portions, and one end of one of said shank portions is pivotally coupled to said web portion.

10. The anchor according to claim 9 wherein said first and second shank portions are configured, dimensioned and arranged for enabling one of said shank portions to be pivoted into overlying abutting relation with the other of said shank portions.

11. An anchor comprising:

shank means;

first and second fluke assemblies, each of said fluke assemblies having a pivot shaft portion;

retainer means for pivotal coupling thereto a portion of said means for pivoting about a first axis, and for pivotally coupling thereto the pivot shaft portions of said first and second fluke assemblies about generally parallel second and third axes, said second and third axes lying in a plane generally including said firs axis, and said first axis lying along a line generally perpendicular to both said second and third axes; and means in engagement with said retaining means for enabling selective pivoting of said first and second fluke assemblies between a first folded position with said fluke assemblies in proximate facing relation and a second unfolded position with the fluke portions of said fluke assemblies in general alignment, and for securing said fluke assemblies in the selected pivoted position, said means in engagement with said retaining means including block means having passage means for slidably receiving said retaining means therein.

12. The anchor according to claim 12 wherein said block means includes detent means for coaction with said fluke assemblies for securing said fluke assemblies in the selected pivoted position.

13. The anchor according to claim 12 wherein said means in engagement with said retaining means includes threaded fastener means coacting with said block means for preventing movement of said retaining means relative to said block means.

14. The anchor according to claim 12 wherein said block means is a generally rectangular box-like member and said passage means is an opening extending therethrough.

15. The anchor according to claim 14 wherein said box-like member includes a plurality of walls having detent means formed therein for coaction with said fluke assemblies for assisting in securing said fluke assemblies in the selected pivoted position.

16. The anchor according to claim 15 wherein said means in engagement with said retaining means includes threaded fastener means coacting with said block means for preventing movement of said retaining means relative to said block means.

17. The anchor according to claim 11 wherein said shank means includes a shank assembly having first and second generally elongate, generally bar-shaped, interconnected shank portions.

18. The anchor according to claim 17. wherein said first and second shank portions are interconnected by means of keyhole slot means.

19. The anchor according to claim 18 wherein said keyhole slot means include a keyhole slot formed in one end of one of said shank portions and a keyed shaft means affixed to one end of said second shank portion with said shaft means engaged within said slot, said first and second shank portions being configured and dimensioned for pivotable movement relative to one another between a folded position with said shank portions in abutting overlying relation and an unfolded position with said keyed shaft means in non-pivoting relation to said keyhole slot and said first and second shank portions pivoted one hundred eighty degrees from said folded position.

20. An anchor comprising:

a shank assembly including first and second shank portions, each having first and second ends and means for pivotally and lockably coupling said first ends to one another;

first and second fluke assemblies, each of said fluke assemblies having a fluke member and a pivot shaft portion;

retainer means for pivotal coupling thereto of a second end of one of said shank portions for pivoting about a first axis, and for pivotally coupling thereto the pivot shaft portions of said first and second fluike assemblis about generally parallel second and third axes, said second and third axes lying in a plane generally including said first axis, and said first axis lying along a line generally perpendicular to both said second and third axes;

means in engagement with said retaining means for enabling pivoting and securing of said first and second fluke assemblies between a first folded position with said fluke members in proximate facing relation and a second unfolded position with said fluke members in general alginment, said means in engagement with said retaining means including wall means defining passage means for slidably receiving said retaining means therein.

21. The anchor according to claim 20 wherein said wall means includes detent means for coaction with said fluke assembles for assisting in securing said fluke assemblies in the selected pivoted position.

22. The anchor according to claim 21 wherein said means in engagement with said retaining means includes fastener means coacting with said wall means for preventing movement of said retaining means relative to said block means.

23. The anchor according to claim 20 wherein said shank means includes a shank assembly having first and second generally elongate, generally bar-shaped shank portions interconnected by means of keyhole slot means.

* * * * *